US009666996B2

(12) United States Patent
Hsu

(10) Patent No.: US 9,666,996 B2
(45) Date of Patent: May 30, 2017

(54) ELECTRICAL CONNECTOR AND METHOD OF MAKING THE SAME

(71) Applicant: FOXCONN INTERCONNECT TECHNOLOGY LIMITED, Grand Cayman (KY)

(72) Inventor: Shuo-Hsiu Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/824,055

(22) Filed: Aug. 11, 2015

(65) Prior Publication Data

US 2016/0043511 A1 Feb. 11, 2016

(30) Foreign Application Priority Data

Aug. 11, 2014 (TW) ..... 103127404 A

(51) Int. Cl.

| | |
|---|---|
| ***H01R 13/648*** | (2006.01) |
| ***H01R 13/6585*** | (2011.01) |
| *H01R 24/60* | (2011.01) |
| *H01R 107/00* | (2006.01) |
| *H01R 12/72* | (2011.01) |
| *H01R 13/6594* | (2011.01) |

(52) U.S. Cl.

CPC ..... *H01R 13/6585* (2013.01); *H01R 12/724* (2013.01); *H01R 13/6594* (2013.01); *H01R 24/60* (2013.01); *H01R 2107/00* (2013.01)

(58) Field of Classification Search

CPC ..... H01R 13/65807; H01R 13/514; H01R 23/005; H01R 23/688; H01R 23/7073; H01R 13/6585

USPC ..... 439/607.05

See application file for complete search history.

(56) References Cited

U.S. PATENT DOCUMENTS 7,758,379 B2 * 7/2010 Chen ..... H01R 13/6485 439/607.11

8,109,795 B2 * 2/2012 Lin ..... H01R 13/6461 439/660

(Continued)

OTHER PUBLICATIONS

Usb Type-C Specification 0.9c05—May. 18, 2014.

(Continued)

*Primary Examiner* — Abdullah Riyami
*Assistant Examiner* — Vladimir Imas
(74) *Attorney, Agent, or Firm* — Wei Te Chung; Ming Chieh Chang

(57) ABSTRACT

An electrical connector includes an insulative housing, a plurality of conductive terminals retained in the insulative housing and a shielding member being retained in the insulative housing. The insulative housing defines a tongue portion extending forwardly. And each conductive terminal defines a contacting portion exposed on a surface of the tongue portion and a soldering portion extending outside of the insulative housing, the conductive terminals includes a plurality of first conductive terminals and a plurality of second conductive terminals of which the contacting portions disposed on opposite surfaces of the tongue portion. The shielding member is disposed between the first conductive terminals and the second conductive terminals. The shielding member is touching the conductive terminals but insulated with the conductive terminals.

11 Claims, 6 Drawing Sheets

(56) References Cited

U.S. PATENT DOCUMENTS

| | | | | |
|---|---|---|---|---|
| 8,262,411 | B2 | 9/2012 | Kondo | |
| 8,480,413 | B2 * | 7/2013 | Minich | H01R 12/724 439/607.05 |
| 8,684,769 | B2 * | 4/2014 | Kao | H01R 13/6471 439/607.28 |
| 8,808,029 | B2 * | 8/2014 | Castillo | H01R 13/6585 439/607.05 |
| 8,851,927 | B2 * | 10/2014 | Hsu | H01R 12/724 439/607.11 |
| 9,178,319 | B2 * | 11/2015 | Little | H01R 13/6585 |
| 9,214,766 | B1 * | 12/2015 | Yu | H01R 13/6585 |
| 9,257,793 | B2 * | 2/2016 | Lo | H01R 13/6461 |
| 9,281,643 | B1 * | 3/2016 | Tseng | H01R 13/518 |
| 9,300,095 | B2 * | 3/2016 | Lin | H01R 24/60 |
| 9,306,336 | B2 * | 4/2016 | Chang | H01R 13/6471 |
| 9,337,588 | B2 * | 5/2016 | Chang | H01R 13/6594 |
| 9,350,121 | B2 * | 5/2016 | Ju | H01R 13/6585 |
| 9,350,126 | B2 * | 5/2016 | Little | H01R 24/60 |
| 2005/0148240 | A1 * | 7/2005 | Kim | H01R 13/6597 439/95 |
| 2005/0287847 | A1 * | 12/2005 | Kamata | H01R 13/6585 439/95 |
| 2014/0024257 | A1 | 1/2014 | Castillo et al. | |

OTHER PUBLICATIONS

Universal Serial Bus Type-C Cable and Connector Specification Revision 1.0 Aug. 11, 2014.

Universal Serial Bus Type-C Cable and Connector Specification Revision 0.7 Working Draft Jan. xx, 2014.

* cited by examiner

ELECTRICAL CONNECTOR AND METHOD OF MAKING THE SAME

BACKGROUND OF THE INVENTION

1. Field of the Invention

The present invention relates to an electrical connector, and more particularly to an electrical connector which can transmit high-frequency signals.

2. Description of the Related Art

Taiwan Pat. No. M370848 issued on Dec. 11, 2009, discloses a USB plug can be connected to a mating connector in two orientations. The plug includes an insulative housing, a plurality of conductive terminals retained in the insulative housing and a metal shell. The insulative housing defines a base portion and a tongue portion extending forwardly from the base portion, each conductive terminal defines a retaining portion fixed into the base portion, a contacting portion extending from one end of the retaining portion and disposed on the tongue portion and a soldering portion extending outside of the base portion from another end of the retaining portion and connected on the PCB. The conductive terminals are divided into two rows and symmetrically arranged into the both sides of the tongue portion so that the mating connector can be mated in two orientations due to the two rows of the conductive terminals with the same signal sequence and reverse arrangement. The conductive terminals on the upper side of the tongue portion are electrically connected when the mating connector is inserted into the plug in a first direction, and the conductive terminals on the lower side of the tongue portion are electrically connected when the mating connector is inverted 180 degrees to be inserted into the plug in a second direction.

However, with the development of the technology, the transmission rate of the electrical connector and the number of the corresponding conductive terminals are increasing so as to the distance between two conductive terminals and the wall thickness of the insulative housing be reduced, which makes the conductive terminals not easy to be assembled. Furthermore, due to the lack of the shielding structure, it is prone to crosstalk in high-frequency signal transmission and affecting the quality of signal transmission.

Therefore, an improved electrical connector is highly desired to meet overcome the requirement.

BRIEF SUMMARY OF THE INVENTION

An object of the present invention is to provide a lower profile electrical connector simple to manufacture and a manufacturing method thereof.

In order to achieve above-mentioned object, an electrical connector includes an insulative housing, a plurality of conductive terminals retained in the insulative housing and a shielding member being retained in the insulative housing. The insulative housing defines a tongue portion extending forwardly, and each conductive terminal defines a contacting portion exposed on a surface of the tongue portion and a soldering portion extending outside of the insulative housing, the conductive terminals includes a plurality of first conductive terminals and a plurality of second conductive terminals of which the contacting portions disposed on opposite surfaces of the tongue portion. The shielding member is disposed between the first conductive terminals and the second conductive terminals. The shielding member is touching the conductive terminals but insulated with the conductive terminals.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
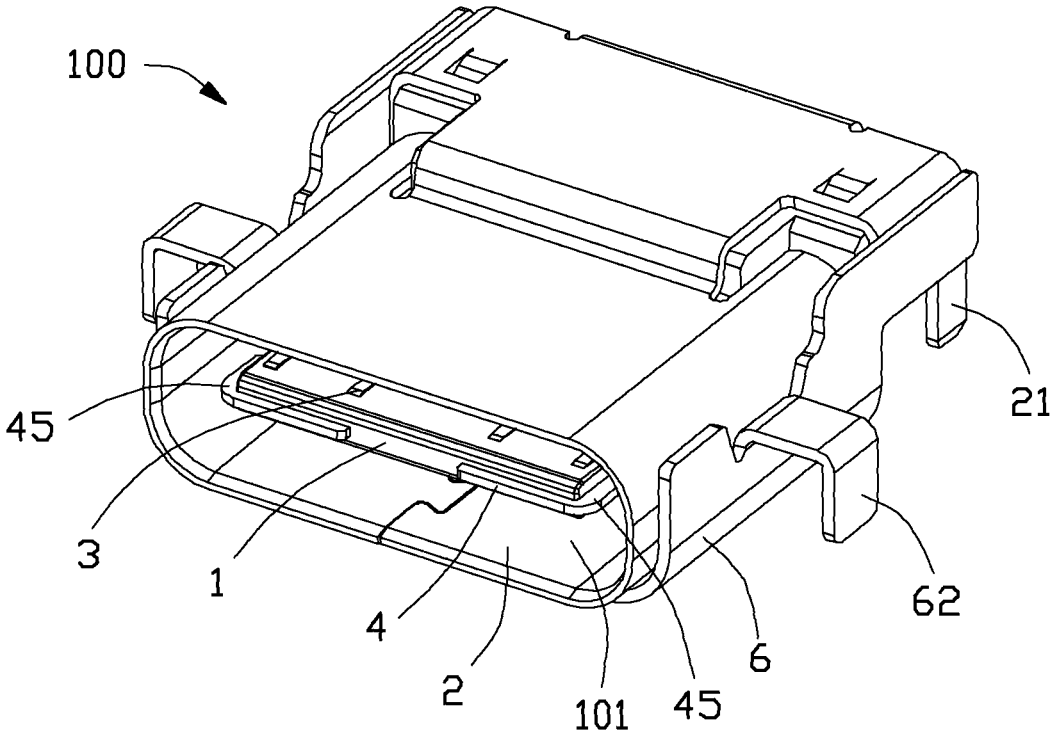
FIG. 1 is a perspective view showing an electrical connector in accordance with the present invention.
Figure 2:
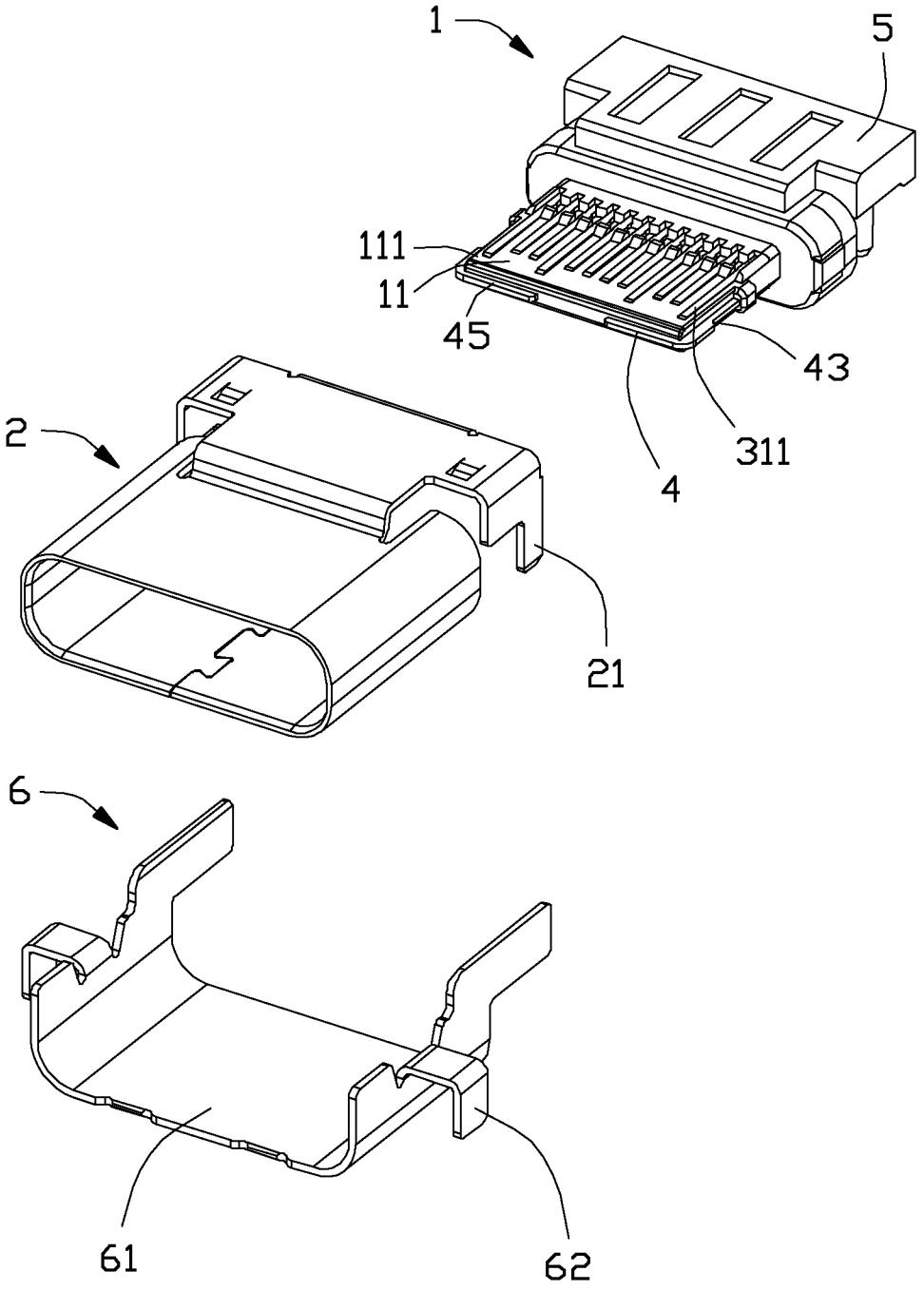
FIG. 2 is an exploded perspective view of the electrical connector shown in FIG. 1.

Reference will now be made to the drawing figures to describe a preferred embodiment of the present invention in detail. Referring to FIG. 1 to FIG. 2, an electrical connector 100 is preferably a plug to be mounted on a printed circuit board for a corresponding mating connector inserted. The electrical connector 100 includes a plurality of conductive terminals 3 divided into two rows, a shielding member 4 positioned between two rows of the conductive terminals 3 and insulated with the conductive terminals 3, an insulative housing 5 injection molding integrally and covering the conductive terminals 3 and the shielding member 4 and a metal shell 2 shielding the insulative housing 5.

Figure 3:
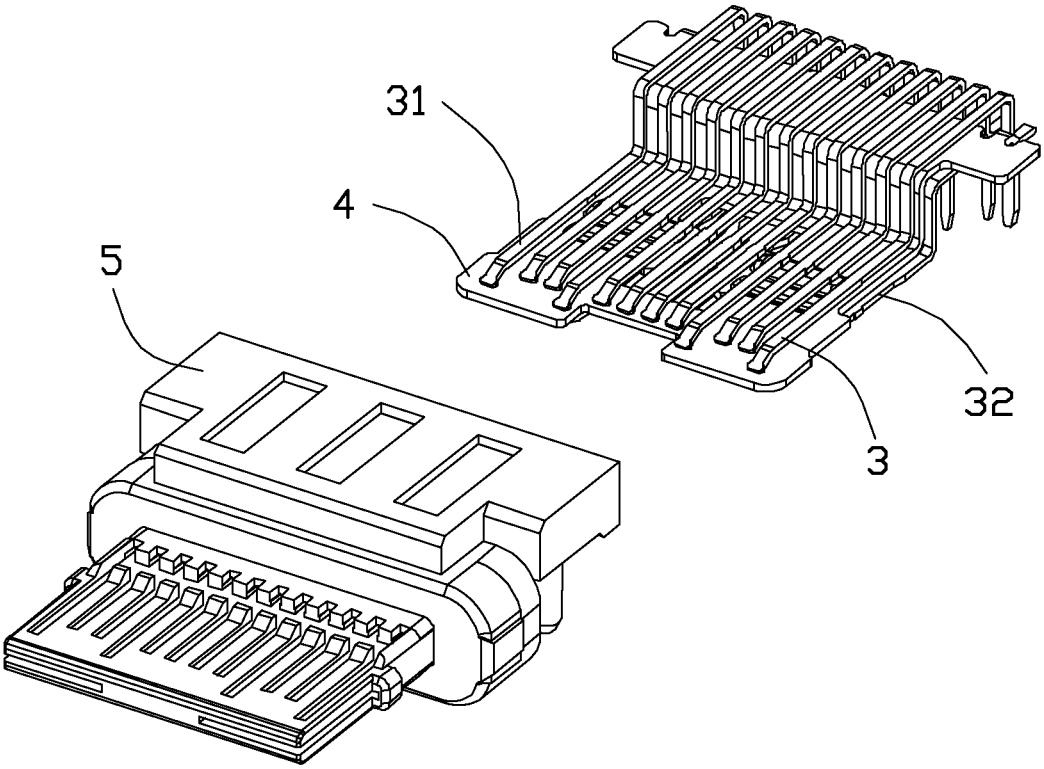
FIG. 3 is an exploded perspective view of a terminal module of the electrical connector shown in FIG. 2.
Figure 4:
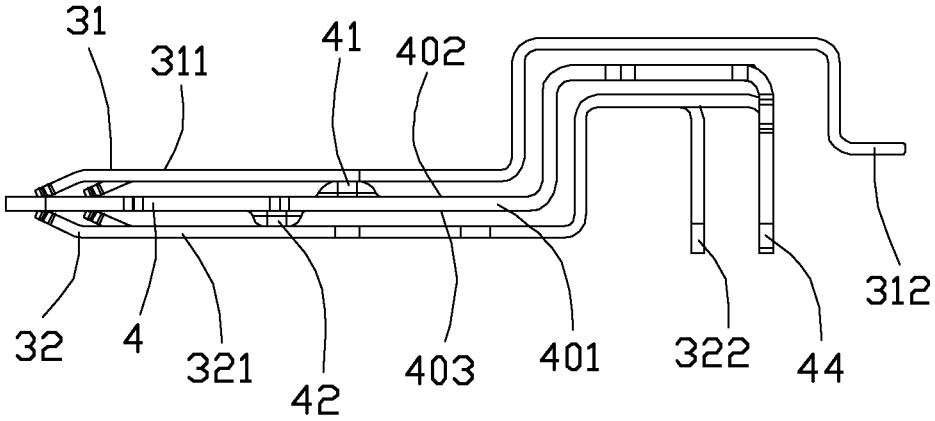
FIG. 4 is a lateral perspective view of the terminals of the electrical connector with a shielding member shown in FIG. 3.
Figure 5:
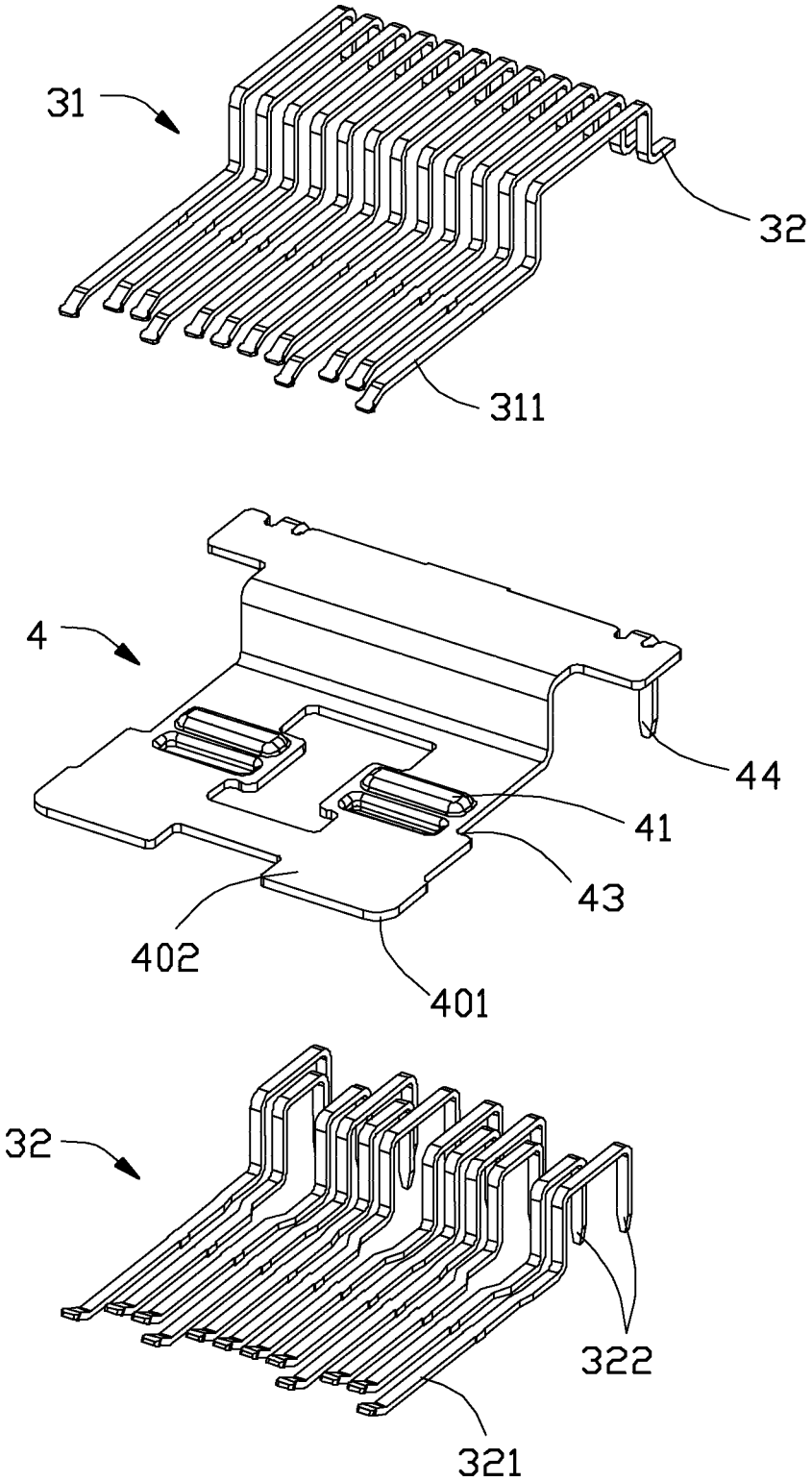
FIG. 5 is an exploded perspective view of the terminals with the shielding member shown in FIG. 4.

Referring to FIG. 3 to FIG. 5, the insulative housing 5 defines a tongue portion 11 extending forwardly and each conductive terminal defines a contacting portion disposed on the tongue portion to be electrically connected to a mating connector and a soldering portion extending outside of the insulative housing 5. The conductive terminals 3 include a plurality of first conductive terminals 31 and a plurality of second conductive terminals 32, the contacting portions thereof are arranged in two rows and located on both sides of the tongue portion 11, respectively, to form the first contacting portions 311 and the second contacting portions 312. A mating interface formed by the tongue portion 11 is central symmetry, and the first contacting portions 311 and the second contacting portions 312 are symmetry along the horizontal centerline of the tongue portion 11 and arranged on both sides of the tongue portion 11 so that the mating connector can be electrically inserted in two orientations. In present embodiment, the tongue portion 11 and the metal shell 2 together form aforementioned mating interface and a mating cavity 101 surrounding the tongue portion 11 to accommodate the mating connector, the first contacting portions 311 and the second contacting portions 312 are arranged symmetrically on both sides of the tongue portion 11 to further improve the reliability of insertion in two orientations. The soldering portion 312 of the first conductive terminals 31 are welded on the print circuit board by Surface Mounted Technology, the soldering portion 322 of the second conductive terminals 32 are welded on the print circuit board by pin type and arranged in two rows, which can reduce the space the conductive terminals occupied and reduce the signal interference between the conductive terminals.

Figure 6:
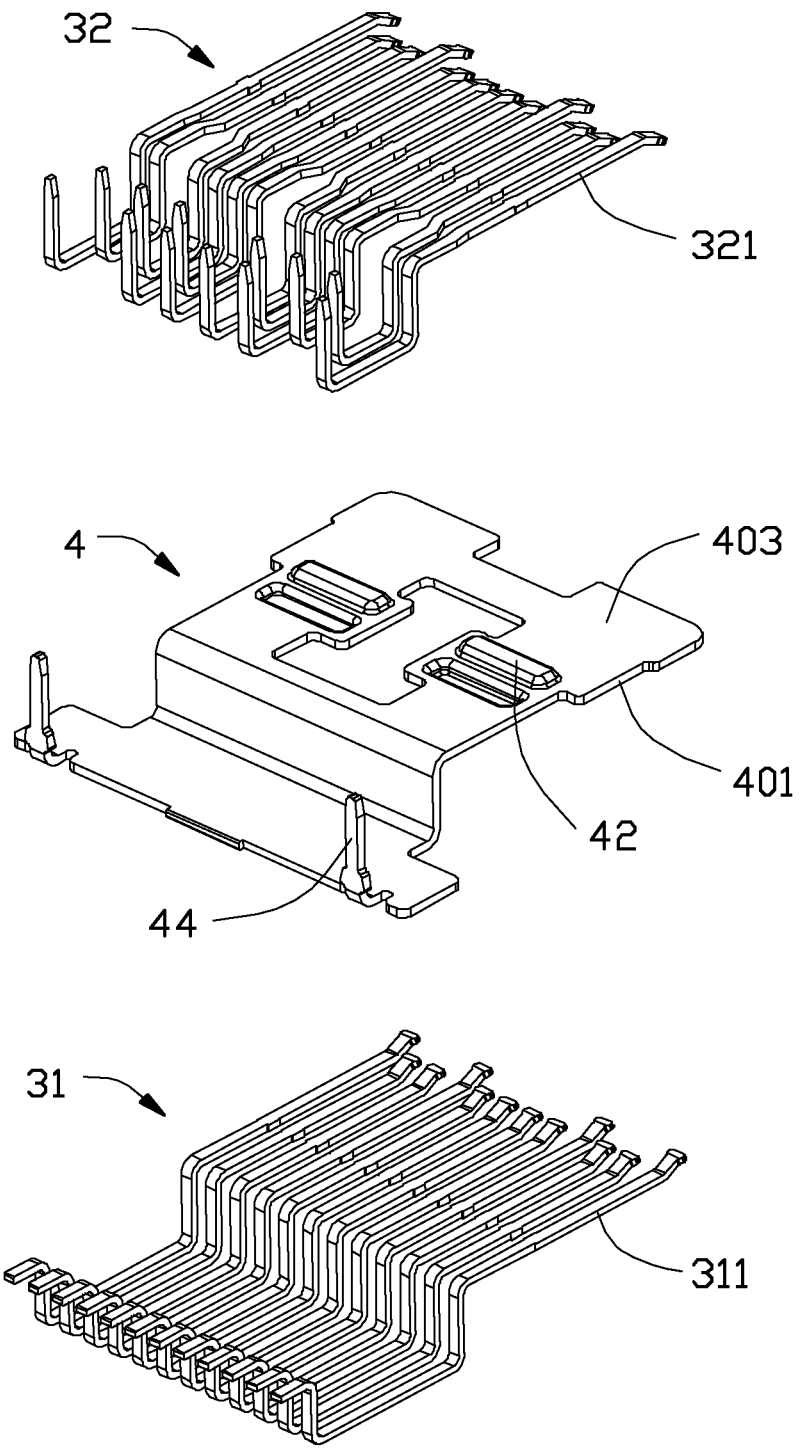
FIG. 6 is another exploded perspective view of the terminals with the shielding member shown in FIG. 5.

Referring to FIG. 6, the shielding member 4 is integrally embedded in the tongue portion and disposed between the first and second conductive terminals to prevent signal interference between the first and second conductive terminals. The shielding member 4 defines a plurality of positioning portions 41, 42 located between the shielding member 4 and the conductive terminals, which makes the conductive terminals 3 having a distance from the shield member 4 and pre-positioning so as to facilitate be integrally molded. The pre-positioning mode can reduce the height of a combination of the shielding member 4, the first and second conductive terminals, especially free ends of the first and second contacting portions are extending to the shielding member 4 so as to reduce the height of the combination in the maximum extent. The shielding member 4 defines a metal base 401 and a pair of insulative spacers 402, 403 attached to both sides of the metal base 401, respectively, so as to form an insulating layer between the shielding member 4 and the conductive terminals 3. The positioning portions are formed by pressing the shielding member 4 and projecting from opposite sides thereof so as to be positioned between the shielding member 4 and the conductive terminals. The insulating layer also extends to the positioning portions 41, 42 so that the positioning portions are not electrically contacting with the conductive terminals 3 when the positioning portions are touching the conductive terminals 3.

The shielding member 4 defines a pair of locking recesses 43 on opposite ends thereof for locking the mating connector and a pair of pins 44 extending outside of the insulative housing 5 for being connected to the printed circuit board, without electrically connected to the metal shell 2. Referring to FIG. 1 to FIG. 2, the electrical connector 100 is assembled on the printed circuit board by a sank type and further includes a fixed member 6. The fixing member 6 defines a base portion 61 retained in the metal shell 2 by a laser spot welding manner and a pair of soldering legs 62 extending from both sides of the base portion 61 for soldered on the printed circuit board in order to achieve an assembly in the sank type. The metal shell 2 defines a pair of pins 21 soldered on the printed circuit board, but in other embodiments, the shielding member 4 is electrically connected to the metal shell 2 so that the shielding member 4 can also achieve grounding function without the aforementioned pin 44. The shielding member 4 further defines a pair of projecting portions 42 projecting forwardly outside of the tongue portion 11, which can be advance electrically contacted with the mating connector when the mating connector is inserted so that it is conducive to enhance the shielding effect. The tongue portion 11 defines two opposite corner portions 111 disposed in front thereof, and the projections 42 are projecting from two corner portions 111 respectively and symmetrically arranged, which is conducive to molding manufacturing.

The method of manufacturing an electrical connector 100 includes the steps of: providing a plurality of first conductive terminals 31 and a plurality of second conductive terminals 32; providing a shielding member 4 positioned between the first and second conductive terminals and insulated with the conductive terminals 3; injection molding and making the first and second conductive terminals and the shielding member integrally fixed so as to form a terminal module 1. Wherein the terminal module 1 includes the tongue portion 11 projecting forwardly, the first contacting portion 311 and the second contacting portion 321 exposed to the opposite sides of the tongue portion 11 and the soldering portion 312, 322 extending outside of the terminal module 1.

The surfaces of both sides of the metal base 401 of the shield member 4 has been insulated so that the insulative spacers 402, 403 are attached on both sides of the metal base 401, respectively, to form an insulating layer between the shielding member 4 and the conductive terminals 3. In present embodiment, the insulative spacers are formed on the metal base 401 by electroplating or spraying. Before injection molding, providing a plurality of positioning portions 41, 42 disposed between the shielding member 4 and the first and second conductive terminals, the positioning portions are formed by the shielding member 4 stamped and projecting integrally from the shielding member 4, whereby the insulating layer is also extending on the positioning portions 41, 42. After injection molding, the metal shell 2 and the fixed member 6 are assembled to the terminal module 1 successively.

Thus, the shielding member 4 is integrally embedded inside the tongue portion 11 of the electrical connector 100, when the high frequency signals is transmitted, especially the conductive number of terminals is larger, it can reduce interference between the terminals and reduce noise. The present invention does not need to multi-pin assembled or two rows of conductive terminals 3 firstly injection molding and then secondary assembly, ie, without multiple process, two rows of conductive terminals and the shielding member are firstly be pre-positioned, then by using only one injection molding mold to form the terminal module so that two conductive terminals and the shielding member are fixed into a whole, it has changed the manner that the multi-row terminals needed for injection molding respectively and then assembly in the prior art. It can have less process and reduce manufacturing difficulty, and it is conducive to the thinner of the electrical connector that the height of the combination formed by the conductive terminals and the shielding member is smaller.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an insulative housing defining a tongue portion extending forwardly;

a plurality of conductive terminals retained in the insulative housing and each defining a contacting portion exposed on a surface of the tongue portion and a soldering portion extending outside of the insulative housing, the conductive terminals including a plurality of first conductive terminals and a plurality of second conductive terminals of which the contacting portions disposed on opposite surfaces of the tongue portion;

a shielding member being retained in the insulative housing and disposed between the first conductive terminals and the second conductive terminals; and the shielding member mechanically touching the conductive terminals but electrically insulated from the conductive terminals, the shielding member defining a plurality of positioning portions disposed between the shielding member and the first and second conductive terminals respectively and touched the corresponding conductive terminals;

there is an insulating layer formed on the positioning portions to separate the shielding member from the first and second conductive terminals.

2. The electrical connector as described in claim 1, wherein the shielding member defines a metal base and a pair of insulative spacers attached to both sides of the metal base, respectively, so as to form an insulating layer between the shielding member and the conductive terminals.

3. The electrical connector as described in claim 2, wherein the free ends of the contacting portions of the conductive terminals are extending to the shielding member but not electrically connected to the shielding member.

4. The electrical connector as described in claim 3, wherein the shielding member defines a pair of projecting portions extending outside of the front end of the tongue portion.

5. The electrical connector as described in claim 1, wherein the shielding member defines a plurality of pins extending outside of the insulative housing and used for grounding connection.

6. The electrical connector as described in claim 1, wherein the electrical connector further includes a metal shell surrounding the insulative housing, the metal shell is electrically connected with the shielding member and defines a plurality of pins used for grounding connection.

7. The electrical connector as described in claim 1, wherein the tongue portion of the electrical connector forms a mating interface which is central symmetry.

8. An electrical connector comprising:

a terminal module including:

a plurality of upper row contacts and a plurality of lower row contacts opposite to each other in a vertical direction, said upper row contacts being side by side arranged with one another and said lower row contacts being side by side arranged with one another in a transverse direction perpendicular to said vertical direction, each of said upper row contacts and said lower row contacts including a front contacting section and rear tail section in a front-to-back direction perpendicular to both said vertical direction and said transverse direction;

a center shielding plate located between the front contacting sections of the upper row contacts and those of the lower row contacts, an insulator integrally formed upon said shielding plate, said contacting sections of said upper row contacts and said lower row contacts via an insert-molding process; wherein said shielding plate is equipped with projections to respectively perform abutment against the contacting sections of said upper row contacts and those of said lower row contacts for supporting during said insert-molding process, and an insulative material is applied between said projections and said contacting sections where said abutment occur for electrical isolation therebetween.

9. The electrical connector as claimed in claim 8, wherein each of said projections is punched outwardly from a main body of the shielding plate in the vertical direction, and said insulative material is an insulative layer applied upon an abutment surface of said projection.

10. The electrical connector as claimed in claim 8, each of said projections extends along the transverse direction.

11. The electrical connector as claimed in claim 8, wherein the projection bulged upwardly and the projection bulged downwardly are offset from each other in the front-to-back direction.

* * * * *